US005381909A

United States Patent [19]

Warnan

[11] Patent Number: 5,381,909

[45] Date of Patent: Jan. 17, 1995

[54] WINCH FOR TOWING SUBMERGED OBJECTS

[75] Inventor: Francois Warnan, Rambouillet, France

[73] Assignee: Thomson-CSF, Paris, France

[21] Appl. No.: 150,064

[22] PCT Filed: Apr. 30, 1992

[86] PCT No.: PCT/FR92/00389

§ 371 Date: Nov. 22, 1993

§ 102(e) Date: Nov. 22, 1993

[87] PCT Pub. No.: WO92/20607

PCT Pub. Date: Nov. 26, 1992

[30] Foreign Application Priority Data

May 21, 1991 [FR] France ..... 91 06110

[51] Int. Cl.[6] ..... B63B 21/66

[52] U.S. Cl. ..... 212/191; 114/244; 114/330

[58] Field of Search ..... 212/191; 114/244, 245, 114/247, 51, 330

[56] References Cited

U.S. PATENT DOCUMENTS

| | | | |
|---|---|---|---|
| 3,150,860 | 9/1964 | Nelson | 114/244 |
| 3,596,070 | 7/1971 | McCool | 114/247 |
| 4,462,330 | 7/1984 | Campbell et al. | 114/244 |
| 4,843,996 | 7/1989 | Darche | 114/245 |
| 4,861,297 | 8/1989 | Warnan et al. . | |
| 4,954,110 | 9/1990 | Warnan . | |
| 4,991,534 | 2/1991 | Warnan et al. . | |
| 5,014,953 | 5/1991 | Warnan et al. . | |
| 5,044,160 | 9/1991 | Warnan et al. . | |
| 5,091,894 | 2/1992 | Warnan . | |
| 5,138,582 | 8/1992 | Furu | 114/245 |

*Primary Examiner*—Michael S. Huppert
*Assistant Examiner*—Thomas J. Brahan
*Attorney, Agent, or Firm*—Oblon, Spivak, McClelland, Maier & Neustadt

[57] ABSTRACT

A winch makes it possible for a fish fitted with sonar to be towed behind a boat. The winch includes a sensor for measuring the attitude of the fish and a device for controlling, using this measurement, a servo cylinder actuator which alters the inclination of the jib to keep this attitude constant. The winch makes it possible to reduce jerks in the tensile stress applied to the cable which tows the fish.

14 Claims, 3 Drawing Sheets

FIG. 3
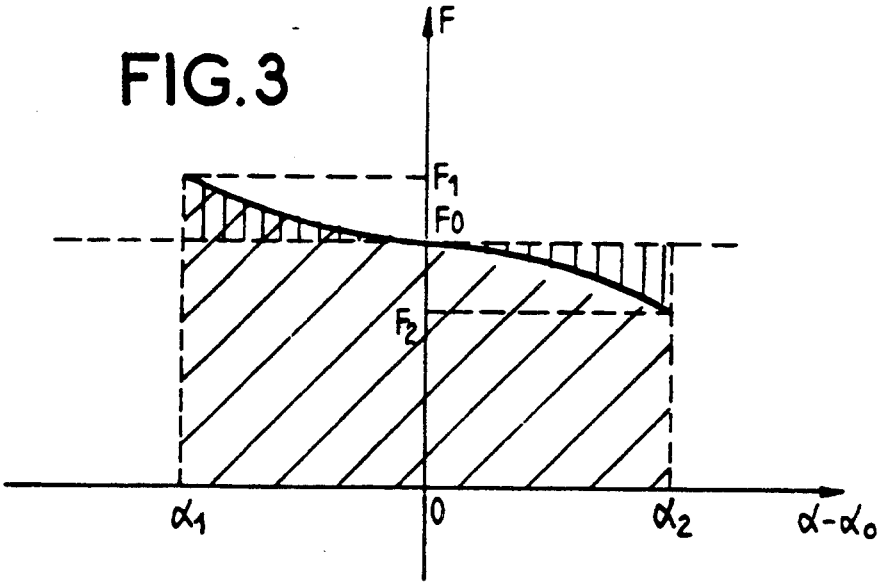
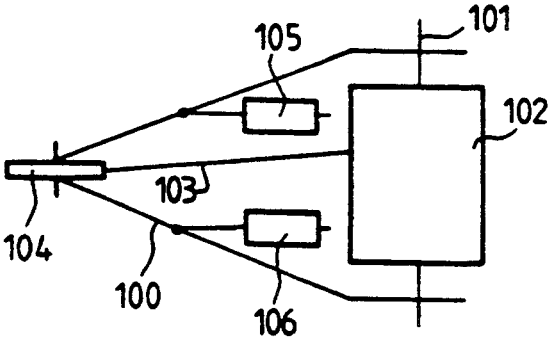
FIG. 4
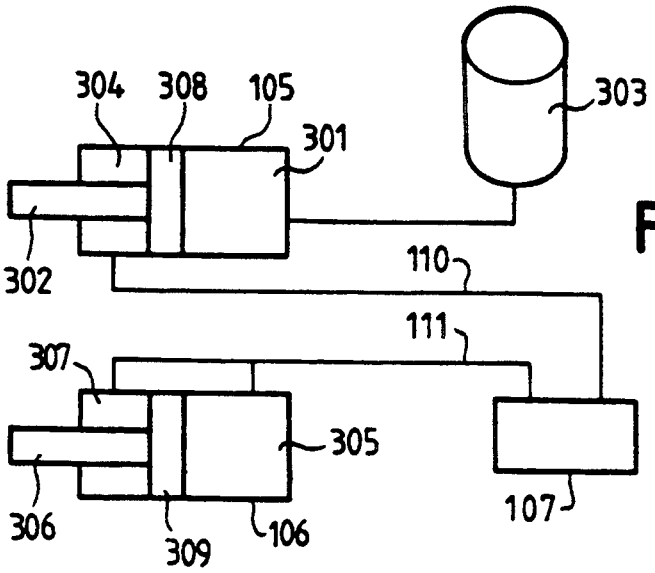
FIG. 5

WINCH FOR TOWING SUBMERGED OBJECTS

TECHNICAL FIELD

The present invention relates to winches which make it possible to tow behind a towing structure, such as an oceanographic ship, a submerged object such as a "fish" containing, for example, sonar for mapping the sea bed.

BACKGROUND ART

It is known to tow, at the end of a cable, behind a boat, a submerged body called a fish because of its resemblance to this animal. Outside these periods of use, the fish is brought back on board the boat by winding up the towing cable on a winch. To facilitate handling, the cable passes over an idling pulley located at one end of an arm articulated at its other end to the boat, in such a way that, by rotating about this articulation, the arm passes from an extended position, in which the pulley hangs out over the sea, to a raised position, in which it hangs out over the deck of the boat. The arm also includes, at this pulley, a device forming a cradle on which the fish comes to rest after it has been raised.

On account of the equipment on board the fish, the latter can reach a considerable mass, of the order of several tones. Since the towing structure moves along only at a relatively low speed, on the order of about ten knots at most, in particular so as not to impose too high a tensile stress on the towing cable, the vertical distance of separation of the fish from the boat is relatively small and the angle between this vertical and the straight line which joins to the boat to the fish is typically on the order of 30°.

Moreover, on account of the stresses which it has to withstand, the traction cable is itself large and heavy. Because of this, it is not possible to neglect its weight in relation to that of the fish and it furthermore is subjected to significant drag. What is more, it exhibits significant deflection in relation to the straight line joining the fish to the boat.

Under the effect of the waves, the boat displays random movements which are passed on to the cable and to the fish. Because of the above effects, the movement of the fish does not reproduce that of the boat and it is therefore not possible, during the processing of the sonar signals for example, to compensate for the movements of the fish simply by taking into account the movements of the boat. What is more, the stresses in the cable due to these movements are absolutely excessive and it is necessary to minimize them as far as possible.

A known solution to this problem consists supporting the arm with the aid of a cylinder actuator connected to a pneumatic accumulator, so that the arm oscillates about its point of articulation on the boat so that the head of the arm follows a substantially rectilinear path at an approximately constant speed. As may be easily imagined, this result is obtained only very approximately with such a passive system. In addition, on account of the masses and stiffnesses involved, the natural frequency of this assembly is, in most cases, relatively close to that of the swell, which leads resonance phenomena liable to increase the stresses applied to the cable.

DISCLOSURE OF THE INVENTION

To mitigate these drawbacks, the invention provides a winch for towing submerged objects, comprising a jib having a base which can pivot on a substantially horizontal pin and a head fitted with an idling pulley for support a towing cable, main means for keeping this jib raised in relation to horizontal at an angle of inclination $\alpha$ which can vary about an average value $\alpha_0$ allowing the towing operations, mainly characterized in that it furthermore includes means for causing the inclination of the jib to vary about $\alpha_0$ so as to limit the variations in the tensile stress in the cable.

BRIEF DESCRIPTION OF THE DRAWINGS

Other features and advantages of the invention will appear clearly in the following description given by way of example which is non-limiting and made with reference to the appended figures wherein:

FIG. 3 is a diagram of the forces as a function of the angle of FIG. 1;

FIG. 4 shows a simplified plan view of this winch; and

FIG. 5 shows a hydraulic circuit for controlling the cylinder actuators.

BEST MODE FOR CARRYING OUT THE INVENTION

Figure 1:
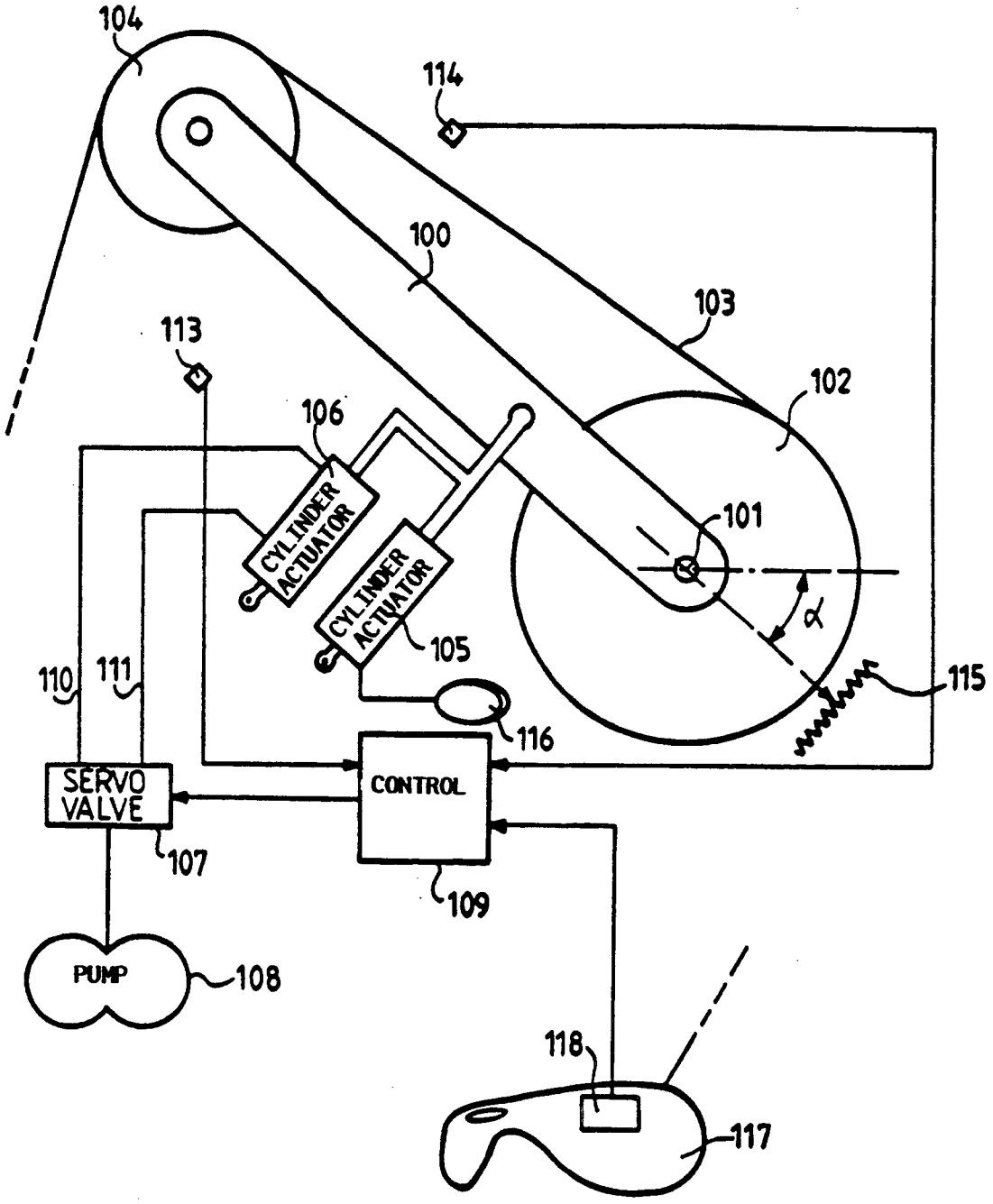
FIG. 1 is a schematic diagram of a winch according to the invention.

FIG. 1 shows the arm 100 of the winch, which is comparable to the jib of a crane, and which supports the cable for towing the fish. This jib 100 is articulated at one end by means of a pin 101 on a frame, not shown, which is itself fixed to the deck of the towing structure. The drum 102 of the winch, which contains the towing cable 103, rotates about this pin 101. This cable 103 is unreeled from the drum 102, turns around an idling pulley 104 located at the other end of the jib 100 and then goes down. When the cable is unwound, it therefore extends into the sea to tow the fish 117 therein.

A load cylinder actuator 105 connected to a hydraulic accumulator 116, fixed on the one hand to the support frame of the winch and on the other hand to the jib 100, allows the latter to be supported and allows it to be caused to pivot about the pin 101 so that this jib makes an angle $\alpha$ with the horizontal.

When the fish is to be raised, it is placed in a cradle, not shown, located at the end of the jib 100 beneath the pulley 104, and the cylinder actuator 105 allows, with the aid of pumping-up means, not shown, the arm to be lifted so as to bring the fish up again above the deck of the structure, the angle $\alpha$ then having a rather large value. Once the fish has been raised above the water, it is brought above the deck of the boat, either by rotating the jib in the horizontal sense or by a backwards translational movement of the latter.

On the other hand, when the cable 103 has been unwound to tow the fish below the water astern of the structure, the cylinder actuator 105 lowers the jib so as to place the end of the latter carrying the pulley 104 above the surface of the water, in order to have a correct deflection of the cable 103 in relation to the stern of the boat. The angle $\alpha$ is then relatively small.

Under these towing conditions, and as a function of the relative movements of the boat, of the surface of the sea and of the fish, the jib 100 tends to oscillate about the pin 101 under the effect of the variations in the tensile stress which are due to these movements. In fact, the stresses go back to the load cylinder actuator 105 which, being for example of the hydraulic type, tends to oscillate under the action of these stresses around the equilibrium point which has been fixed by the means for pumping up the cylinder actuator.

As was mentioned earlier, the elastic assembly formed by all these elements, and especially by the jib and the load cylinder actuator, does not allow the tensile stresses imposed on the cable 103 by these relative movements to be damped correctly.

According to the invention, a servo cylinder actuator 106, which is connected to a servovalve 107 supplied by a pump 108, has been arranged in parallel with the load cylinder actuator 105. A electronic control device 109 allows the servovalve 107 to be controlled so as to supply the servo cylinder actuator 106 via two supply hoses 110 and 111. In this manner, the cylinder actuator 106 thrusts the jib upwards or pulls it downwards so as to keep a substantially constant tensile stress in the cable 103, and also so as to keep a substantially constant height at the end of the jib.

Various parameters may be used to control the servovalve 107 by means of the control device 109.

According to the invention, sensors 118 are used which are located in the fish 117 and which measure the attitude of this fish. The signals coming from these sensors are applied to the control box 109 via a connection shown separately in the figure, but which in practice passes via the towing cable 103, in an arrangement known in the art. Indeed it is even pointless in general to provide specific transmission means and sensors as these already exist and are normally used to correct the information from the apparatuses, sonar for example, contained in the fish. It therefore suffices to extract, from the exploitation members located in the boat, the signals corresponding to the attitude angle of the fish and to apply them to the box 109.

This box operates in an open-loop mode by applying signals to the servovalve 107 which tend to bring the attitude of the fish back to 0. If the attitude increases, the cylinder actuator is supplied in one direction and if it decreases it is supplied in the other. The box 109 is therefore equivalent to a differential amplifier. As this system operates in open-loop mode, it is possible to use a relatively high gain without too great a risk of oscillation, at the very least to some degree. In fact, there is indeed a feedback, which is mechanical, via the intervention of the tension in the cable itself. The mass of the cable/fish assembly and the elasticity of this cable are thereby automatically taken into account in the control, and the results are excellent.

In practice, it is found that above a certain value of the gain of the control 109, an oscillation having a frequency of a few Hz, for example 5 Hz, is obtained. It then suffices to bring the gain back to a value slightly below this limiting value to be steady in all circumstances, even in rough seas, at the very least for cable lengths below 50 m. Above this, the oscillations reappear because of the increase in the elasticity and in the mass. To reduce the oscillations, the gain is divided by 2 between 100 and 150 m, and then by 3 above that. Indeed, a length is finally reached such that the elasticity damps out by itself the movements of the swell, such that the device is no longer necessary.

To compensate for drift, in the amplifier for example, it is possible to introduce into the control signal a correction signal coming, for example, from a potentiometer 115 giving the position of the jib, with a relatively low gain, to prevent the jib from hitting a limit stop.

Figure 2:
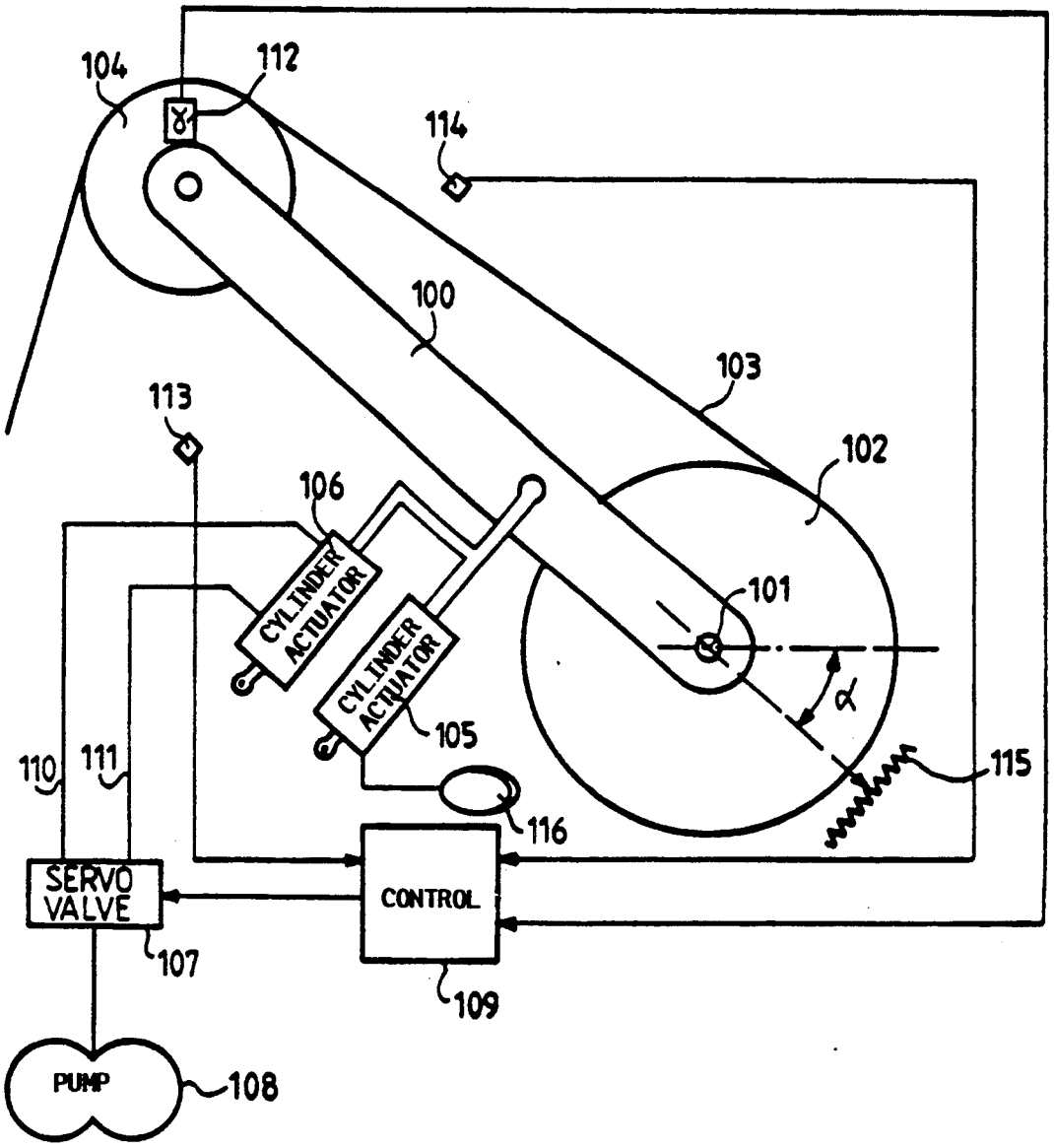
FIG. 2 is a variant of FIG. 1.

According to one variant of the invention, it is possible to use, as shown in FIG. 2, an accelerometric sensor 112 fixed to the end of the jib supporting the pulley 104. This sensor is arranged so as to measure substantially the vertical component of the acceleration. To do this, various arrangements can be used, the simplest of which consists in using an accelerometer sensitive along a single axis and fixed to the end of the jib so that this axis is substantially vertical for the position of the jib corresponding to the standard towing conditions. It has been possible to show that this arrangement was sufficient to minimize the jerks on the cable correctly as the latter can withstand reasonable stress variations and it is therefore pointless to obtain a perfect system which would be extremely difficult to produce.

The signals coming from the accelerometer 112 are therefore applied to the control device 109 in which they undergo processing which allows control signals to be applied to the servovalve 107 to supply the cylinder actuator 106 in such a way that the vertical acceleration at the head of the jib is minimal. The electronic control box 109 implements a servo-controlled procedure very similar to those known in the current art. The procedure used consists, for example of a double integration leading to positional control of the jib or of a single integration leading to control of the speed, the parameters of these controls allowing the instantaneous value of the acceleration to be minimised.

The implementation of this procedure and of its variant uses, in the control box, either standard-type analogic circuits or, preferably, digital circuits, such as a microprocessor suitably programmed for implementing the procedure.

As has been emphasized, it is neither useful nor necessary to have a perfect device, and under these conditions, some drift is observed which is, in any case, inevitable in the case of the variant, even with the most accurate devices since at least one integration is performed using the value of the acceleration. To limit the effects of this drift, two detectors 113 and 114, of the end-of-travel type for example, are used which are placed on either side of the jib at positions corresponding to the maximum permissible deflection, for example $\pm 5°$ about the set-point value of the angle $\alpha$. These devices are connected to the control box 109 and, when the jib actuates one of them, this devices emits a signal which is detected in this control box, which leads to a correction of the signal applied to the servovalve so as to return the jib slowly to the correct value of the angle $\alpha$. An angle sensor 115 can also be used. In this case, the correction is carried out by a long integration on this angle sensor.

The diagram of FIG. 3 shows the total force F applied to the jib as a function of the angle $\alpha-\alpha_0$, $\alpha_0$ being the average value which would correspond to an absence of movement of the boat. $\alpha_1$ and $\alpha_2$ are the two limit-stop values corresponding to the two end-of-travel devices 113 and 114.

If the cylinder actuator 105 alone were supplied by a servovalve controlled by the electronic circuits, the value of the force applied by this load cylinder actuator 105 would vary about an average value $F_0$ with extreme values $F_1$ and $F_2$ corresponding to $\alpha_1$ and $\alpha_2$. The work to be provided by the pump for supplying this cylinder actuator would therefore be proportional to the obliquely hatched area, which is considerable.

According to the invention, by using an auxiliary servo cylinder actuator 106, the force applied by the load cylinder actuator 105 remains permanently substantially equal to $F_0$, whereas the force exerted by the servo cylinder actuator 106 varies between $F_1$–$F_0$ and $F_0$–$F_2$ since this force sometimes reinforces and sometimes counteracts the action of the load cylinder actuator. Under these conditions, the work developed by the pump 108 is therefore equal to the vertically-hatched area which is much smaller than the previous one.

Therefore, by using a servo cylinder actuator which is placed parallel with the load cylinder actuator, it is possible to use a pump having a power which is much less than if the load cylinder actuator were to be supplied directly. As a consequence, the size of the other hydraulic members (servovalve, hoses, etc.) is reduced.

The mounting of the two cylinder actuators shown in FIG. 1 on the same side of the jib with the two thrust shafts joined together corresponds to an explanatory purpose.

To facilitate the construction of the device, a mounting is preferably used such as shown diagrammatically in FIG. 4 which corresponds to a plan view of the elements of FIG. 1.

As is seen, the jib 100 of the crane is in the form of a triangle whose base is fixed to the pin 101 and whose apex receives the pulley 104. This triangle is formed by two arms.

The load cylinder actuator 105 is fixed to one of the two arms and the servo cylinder actuator 106 to the other. On account of the sizes to be used for the components forming the crane, because of the permanent tensile stress to be withstood, there is no risk of the obliquely-applied stresses occasioned by this arrangement leading to operational difficulties or to distortions of the assembly.

In an embodiment variant shown diagrammatically in FIG. 5, which has been limited to the members which are useful in understanding the variant, not only is the cylinder actuator 106 supplied by the servovalve 107 but also the cylinder actuator 105. This cylinder actuator 105 comprises, completely normally, a first chamber 301 located on the other side of the thrust shaft 302 in relation to a piston 308 and supplied by a pressurized tank 303 which allows a substantially constant force $F_0$ to be obtained with the cylinder actuator 105 irrespective of the extent to which the rod 302 is pushed in.

The cylinder actuator 105 furthermore comprises, on the thrust rod side, a second chamber 304 which is itself supplied by the servovalve 107 so as to counteract the effect of the pressure exerted in the chamber 301. What is more, the servovalve 107 supplies the cylinder actuator 106 so as to reinforce the action of the cylinder actuator 105.

The supply of the cylinder actuator 106 can be carried out in two different ways:

in a first case, in which the cylinder actuators 105 and 106 are different, a cylinder actuator 106 smaller than the cylinder actuator 105 is used so that the chamber 305, located on the other side of the thrust rod 306 in relation to the piston 309 of this cylinder actuator, has a cross-sectional surface area equal to that of the chamber 304, taking into account the size of the thrust rod 302;

in a second case, two identical cylinder actuators are used and, for the cylinder actuator 106, both the chamber 305 and the chamber 307 which lies on the thrust rod 306 side are supplied. The thrust obtained with the cylinder actuator 106 then corresponds to the difference in the forces exerted on the two faces of the piston 309, which are not identical since the cross-section of the rod 306 is to be subtracted from the surface-area of the piston on the chamber 307 side. In order for the thrusts for servo-controlling the cylinder actuators 105 and 106 to be equal, these cylinder actuators, identical to each other, are then chosen in such a way that the cross-section of the rods 302 and 306 is equal to the free surface-area of the pistons 308 and 309 on the chambers 304 and 307 side.

Cylinder actuators also exist commercially which include, in a single cylinder, two pistons fixed to the same single thrust rod. The piston located at the end of the rod delimits, in the cylinder, a main thrust chamber connected to the accumulator. The piston located on the rod delimits, in interaction with an intermediate partition which is fixed to the inner wall of the cylinder and in which the rod slides, two servo-control chambers connected to the servovalve. It is thus possible to use a single cylinder actuator for fulfilling the two functions.

Obviously, numerous modifications and variations of the present invention are possible in light of the above teachings. It is therefore to be understood that within the scope of the appended claims, the invention may be practiced otherwise than as specifically described herein.

I claim:

1. A winch for towing submerged objects with a towing cable, which comprises:

a jib having a drum, a substantially horizontal pin about which the drum rotates and an idling pulley connected to the jib to support the towing cable, main means for keeping said jib raised in relation to horizontal at an angle of inclination $\alpha$ which is variable about an average value $\alpha_0$ for allowing towing operation, and means for causing the inclination of the jib to vary about average value $\alpha_0$ so as to limit the variations in the tensile stress in the cable, wherein the means for causing the inclination of the jib to vary comprises means for measuring the attitude of a submerged object towed by the winch, and control means for relieving and counteracting stresses developed by the main means for keeping the jib substantially at the angle $\alpha$ in order to keep this attitude at a substantially constant value.

2. Winch according to claim 1, wherein the constant value corresponds to the horizontal.

3. Winch according to claim 1 or 2, which comprises means for adjusting the gain of the control means to just below the threshold for oscillation of the assembly.

4. Winch according to claim 3, wherein the gain is adjusted as a function of a length dimension of the towing cable.

5. Winch according to any one of claims 1 or 2, which comprises a loading cylinder actuator for supporting the jib with a substantially constant force and a servo cylinder actuator supplied by a servovalue for applying, to the jib, a variable force which is added to or subtracted from the force exerted by the main cylinder actuator.

6. Winch according to claims 1 or 2, which comprises limit stops for detecting maximum and minimum values $\alpha_1$ and $\alpha_2$ of the inclination of the jib and for actuating the control means so as to reestablish the inclination angle $\alpha_0$.

7. Winch according to claims 1 or 2, which comprises an angle sensor for detecting maximum and minimum values $\alpha_1$ and $\alpha_2$ of the inclination of the jib and for actuating the control means so as to establish the average inclination angle $\alpha_0$.

8. A winch for towing submerged objects with a towing cable, which comprises:

a jib having a drum, a substantially horizontal pin about which the drum rotates and an idling pulley connected to the jib to support the towing cable, a main mechanism for keeping said jib raised in relation to horizontal at an angle of inclination $\alpha$ which is variable about an average value $\alpha_0$ for allowing towing operation, and a mechanism for causing the inclination of the jib to vary about average value $\alpha_0$ so as to limit the variations in the tensile stress in the cable, wherein the mechanism for causing the inclination of the jib to vary comprises a mechanism for measuring the attitude of a submerged object towed by the winch, and a control mechanism for relieving and counteracting stresses developed by the main mechanism for keeping the jib substantially at the angle $\alpha$ in order to keep this attitude at a substantially constant value.

9. Winch according to claim 8, wherein the constant value corresponds to the horizontal.

10. Winch according to claims 8 or 9, which comprises a mechanism for adjusting the gain of the control mechanism to just below the threshold for oscillation of the assembly.

11. Winch according to claim 10, wherein the gain is adjusted as a function of a length dimension of the towing cable.

12. Winch according to any one of claims 8 or 9, which comprises a loading cylinder actuator for supporting the jib with a substantially constant force and a servo cylinder actuator supplied by a servovalue for applying, to the jib, a variable force which is added to or subtracted from the force exerted by the main cylinder actuator.

13. Winch according to claims 8 or 9, which comprises limit stops for detecting maximum and minimum values $\alpha_1$ and $\alpha_2$ of the inclination of the jib and for actuating the control mechanism so as to reestablish the inclination angle $\alpha_0$.

14. Winch according to claims 8 or 9, which comprises an angle sensor for detecting maximum and minimum values $\alpha_1$ and $\alpha_2$ of the inclination of the jib and for actuating the control mechanism so as to establish the average inclination angle $\alpha_0$.

* * * * *